US007923618B2

(12) United States Patent
Gholson, Jr.

(10) Patent No.: US 7,923,618 B2
(45) Date of Patent: Apr. 12, 2011

(54) "ECLIPSE LIGATURE" FOR SINGLE REED MUSICAL INSTRUMENTS

(75) Inventor: General James Gholson, Jr., Memphis, TN (US)

(73) Assignee: University of Memphis Research Foundation, Memphis, TN (US)

( * ) Notice: Subject to any disclaimer, the term of this patent is extended or adjusted under 35 U.S.C. 154(b) by 93 days.

(21) Appl. No.: 12/431,201

(22) Filed: Apr. 28, 2009

(65) Prior Publication Data

US 2010/0269668 A1 Oct. 28, 2010

(51) Int. Cl.
*G10D 7/00* (2006.01)

(52) U.S. Cl. ..... 84/383 R; 84/380 R

(58) Field of Classification Search ..... 84/380 R, 84/383 R, 383 A, 385 A
See application file for complete search history.

(56) References Cited

U.S. PATENT DOCUMENTS

D277,967 S 3/1985 Gholson, Jr.
D367,074 S * 2/1996 Gholson, Jr. ..... D17/13

* cited by examiner

*Primary Examiner* — Kimberly R Lockett
(74) *Attorney, Agent, or Firm* — Saliwanchik, Lloyd & Eisenschenk

(57) ABSTRACT

The subject invention pertains to a ligature for securing a single-beating reed to a mouthpiece of any single reed woodwind instrument. According to a specific embodiment, the subject ligature can be provided with two rounded ribs affixed to the interior of a three-fingered collar that is held together across a longitudinal split by tightening screws. One of the two rounded ribs is provided with a concavity opening into the interior of the collar in order to create a triangular negative space on a surface of a secured reed. This negative space allows for asymmetrical pressure to be exerted onto the reed, which can result in a freedom of vibration and may provide subtle improvements in tone, control, articulation, and richness in the core of sound.

20 Claims, 5 Drawing Sheets

"ECLIPSE LIGATURE" FOR SINGLE REED MUSICAL INSTRUMENTS

BACKGROUND OF THE INVENTION

Woodwind instruments are musical instruments that produce sound when a player blows air against an edge or opening of the instrument, causing the air to vibrate within a resonator. The name woodwind stems from the material used to blow air against. Although many woodwind instruments are still made from wood, certain woodwind instruments may now utilize metal or plastics.

Woodwind instruments include single reed instruments, double reed instruments and flutes. A reed is a thinly sliced piece of wood (typically cane) or plastic, over which a player blows. Single reed instruments use a reed that is held against the aperture of a mouthpiece with a ligature. When air is forced between the reed and the mouthpiece, the reed vibrates, creating the sound. Single reed instruments include clarinets and saxophones.

A ligature of a single reed instrument usually extends circumferentially around the entire outer body of the mouthpiece to hold the reed in place on the mouthpiece. Typically, screws are used to tighten the circumference of the ligature in conformance with the general shape of the mouthpiece and outer face of the reed in order to secure the reed to the mouthpiece. Because of the mechanical coupling between the ligature, the mouthpiece, and the reed, the structure of the ligature plays a role in the sound produced by the instruments.

BRIEF SUMMARY OF THE INVENTION

Embodiments of the present invention relate to a ligature to secure a vibrating, beating reed to a mouthpiece of a clarinet or other single reed woodwind instrument. Embodiments of the subject ligature provide asymmetrical pressure to a secured reed.

According to an embodiment, the subject ligature can be made entirely of a non-dampening material, such as metal. The subject ligature can be provided with two rounded ribs affixed to the interior of a collar. The two rounded ribs exert pressure on a single reed as the collar clamps around the mouthpiece, thereby holding the reed in place. Screws may be utilized to further conform the collar to the mouthpiece and reed. One of the rounded ribs causes the ligature to exert the asymmetrical pressure by being fashioned with a concave depression while the other rib has a solid, cylindrical surface. The rib having the concave depression can be the rib most proximal to the heads of the screws, such that the concave depression opens to the interior of the collar. This configuration is operable in ligatures configured to have one or more tightening screws.

In a specific embodiment, the collar can be a three-fingered collar. In a further embodiment, in operation, each finger of the three-fingered collar can form a ring having a different diameter.

In accordance with embodiments of the present invention, a ligature is provided capable of exhibiting strength, resiliency, and adaptive negative-space.

BRIEF DESCRIPTION OF THE DRAWINGS

FIG. 4A shows the screw manipulating side and FIG. 4B shows the opposite side.

FIG. 5A shows a proximal end view and FIG. 5B shows a distal end view.

DETAILED DISCLOSURE OF THE INVENTION

Embodiments of the present invention can apply to all musical instruments using a single-beating reed affixed to and held against a mouthpiece. While saxophones and clarinets are primarily of this class, other lesser known instruments may be deemed to be aligned in this category, such as the occasional oboe having a single-beating reed. Specific embodiments are particularly applicable to the Bb, Eb and A clarinets commonly used in bands and orchestras. Implementations of the subject ligature can be applied to any standard mouthpiece without any modification or structural alteration of the mouthpiece. This ability is especially useful as it allows application of the ligature not only to common, mass-manufactured mouthpieces, but also to many highly prized archived mouthpieces, such as Charles and Henry Chedeville mouthpieces.

According to the present invention, the subject ligature is configured to provide asymmetrical pressure to a reed. To achieve this result, negative space is asymmetrically created by the interior of the subject ligature while supporting a reed against a mouthpiece. According to embodiments of the present invention, the asymmetrical negative space is a result of a concave depression at a surface of a supporting rib that extends longitudinally parallel to the split across the subject ligature. The concave depression, or "concavity," can have an ellipsoidal shape with a cross-section reminiscent of a crescent or half moon in certain embodiments.

According to certain implementations of the subject ligature, subtle improvements in tone, control, articulation, and richness in the core of the sound can be achieved.

Figure 1:
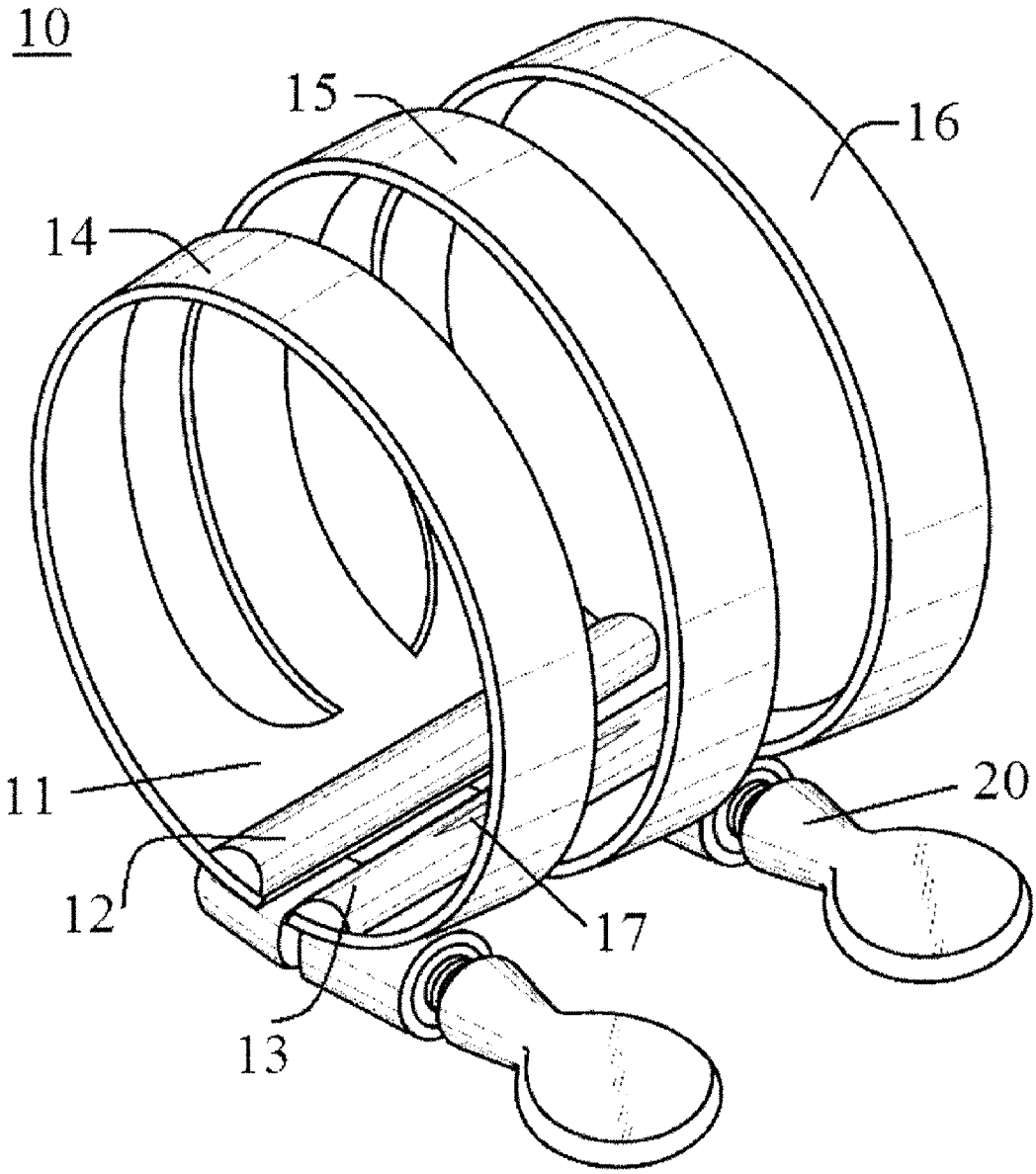
FIG. 1 shows a perspective view of a ligature in accordance with an embodiment of the present invention.

Referring to FIG. 1, a ligature 10 in accordance with an embodiment of the present invention can include an elastically deformable main body 11 capable of conforming around a mouthpiece and reed, longitudinally arranged rounded ribs 12 and 13 at each end of the body, and tightening screws 20 for bringing together or separating the ends of the body, and thus rounded ribs 12 and 13, when respectively securing and removing the reed.

Figure 2:
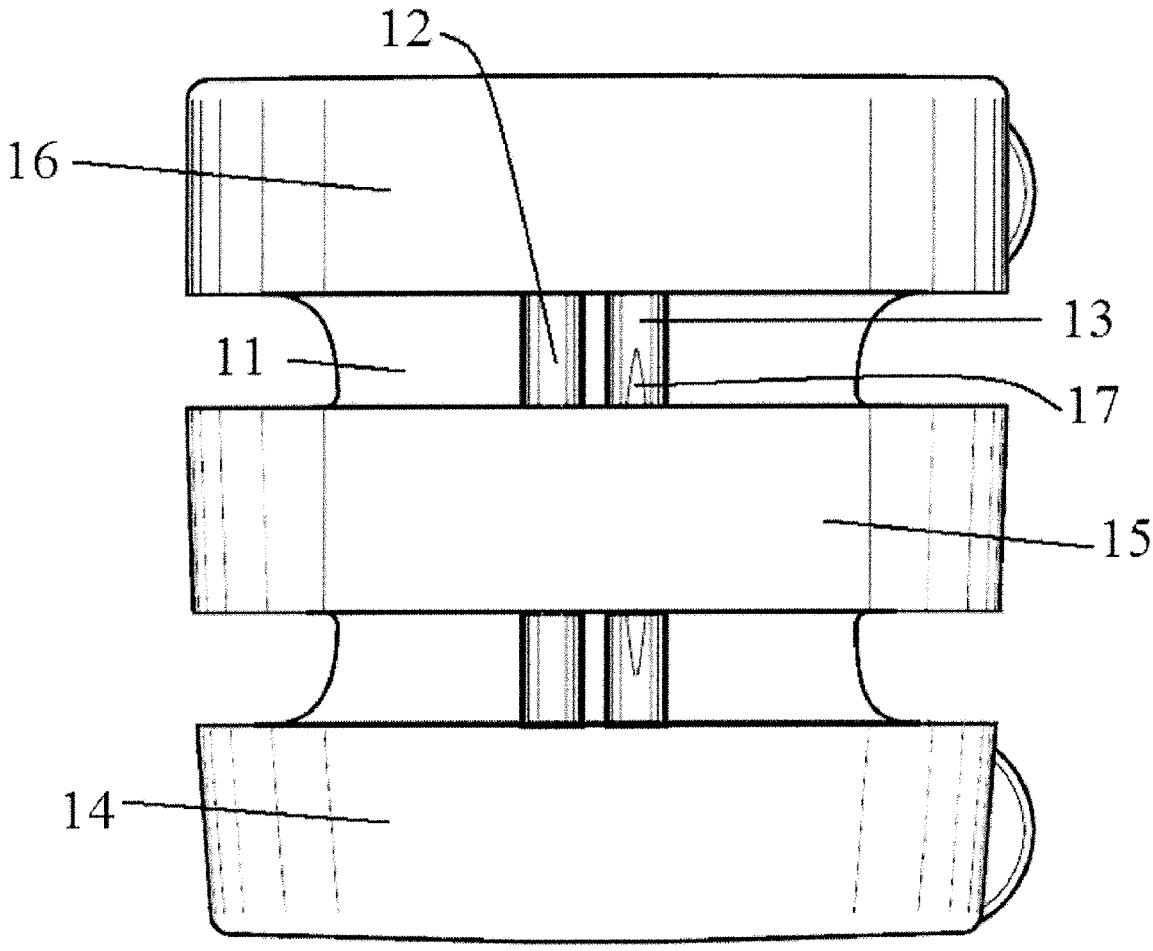
FIG. 2 shows a rib-side (top) view of a ligature in accordance with an embodiment of the present invention as it would appear being viewed from the interior of the collar.

According to the invention, one of the rounded ribs includes a concavity on its surface facing the interior of the collar, positioned such that when the ligature is in use, the exposed internal surface of the concavity is not in contact with the surface of a reed (It seems to function similarly to the bottom of a violin bridge which creates a hollow through which vibrations resound and escape). In various embodiments, the longitudinal extremes of the concavity terminate as rounded ends. The concavity preferably has a "scooped out" or elliptical appearance, gradually increasing in depth from one end towards its middle and then decreasing in depth from the middle to the other end. This keeps the rib strong while at the same time adapting and creating a hollow on top of the reed. The concavity in preferred embodiments has an ellipsoidal shape when viewed from above. For example, as shown in FIGS. 1 and 2, the concavity 17 can begin at a point at one end and increase in width until its mid-point, which in the depicted embodiment is about half-way down the rib 13, and then decreasing in width to its opposite end. In a longitudinal direction with respect to the rib, embodiments of the concavity are more preferably approximately ⅓ to ½ to ⅔ the length of the rib, although in alternative embodiments its length may be greater or lesser. It is preferred that the concavity be the middle ⅓ of the length of the rib, with its maximum length being limited by the length of the rib. In a lateral dimension of a preferred embodiment, the width of the concavity at its longitudinal and vertical center is the complete width of the rib. At its widest extreme, the width may be as great as the diameter of the rib will allow, but the depth should be at least ¼ the diameter of the rib. At its deepest point, preferred embodiments of the concavity are ⅜ to ⅝ the diameter of the rib, although in alternative embodiments its depth may be somewhat greater or lesser.

The elastically deformable main body 11 can be provided having three finger-like rings 14, 15, and 16 that are attached to the face of the ligature in a manner of a collar or ring. The three-fingered collar can be held together across a longitudinal split by the tightening screws 20.

Figure 3:
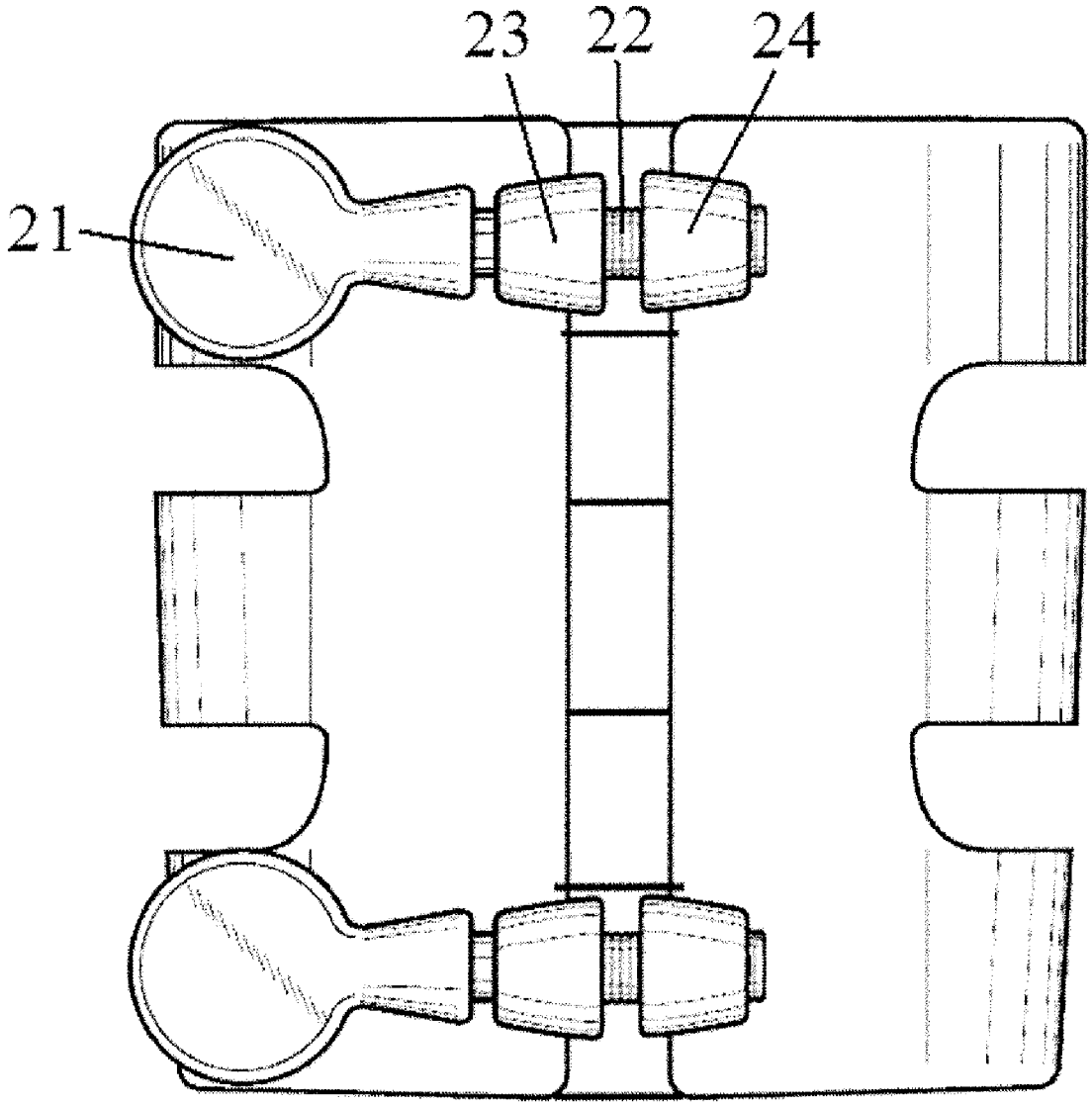
FIG. 3 shows a fastening-side (bottom) view of a ligature in accordance with an embodiment of the present invention as it would appear being viewed external of the collar.

Referring to FIG. 3, the tightening screws 20 can include finger pads 21 for providing a manual grip and spiral threads 22 down the screw shaft. First and second cylindrical elements 23 and 24 affixed to the main body 11 can include interior threads (not shown). The second cylindrical element 24 can include a nut (not shown), which can be separate or integral with the cylindrical element 24.

Figure 4A:
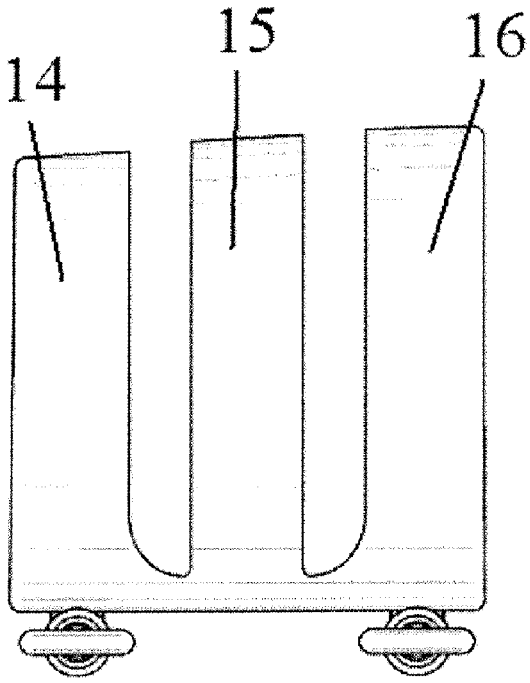
FIGS. 4A and 4B show outer longitudinal side views of a ligature in accordance with an embodiment of the present invention.
Figure 4B:
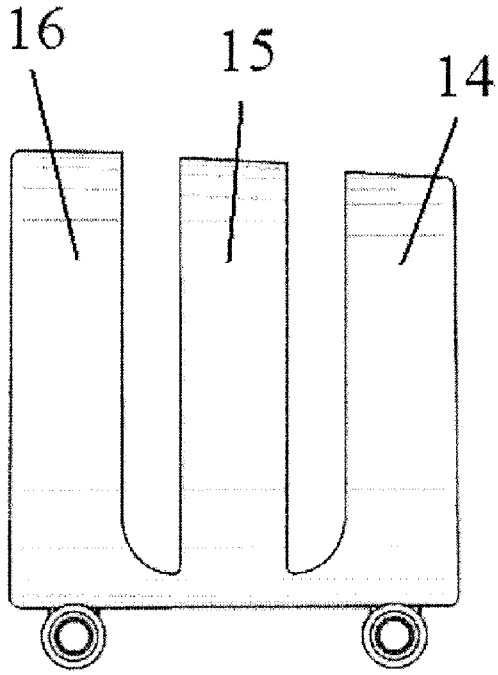

Referring to FIGS. 4A and 4B, the three finger-like rings can have varying diameters, which allow for an increasing diameter of the combined mouthpiece and reed. For example, the proximal ring portion 14 can have a narrower diameter than the distal ring portion 16. Although the subject ligature is shown having a right-handed screw mechanism, embodiments are not limited thereto.

Figure 5A:
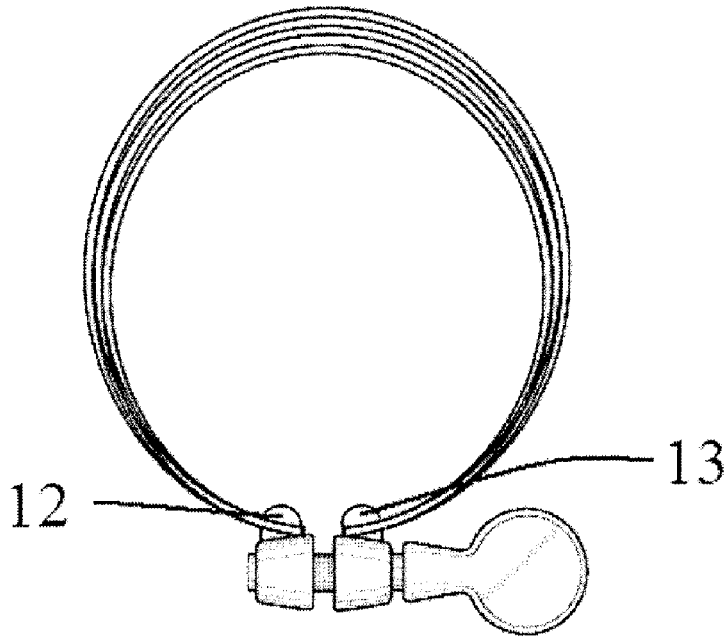
FIGS. 5A and 5B show end-on views of a ligature in accordance with an embodiment of the present invention.
Figure 5B:
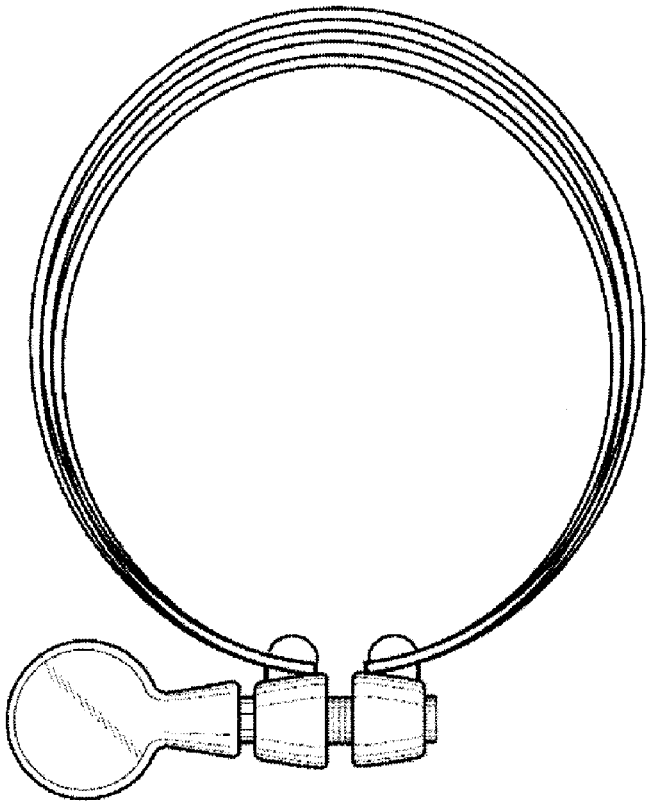

As shown in FIGS. 5A and 5B, the longitudinally arranged rounded ribs 12 and 13 are shaped for smoothly gliding down the rounded surface of a reed (not shown). When a reed is in place, the rounded ribs 12 and 13 rest against the rounded surface of the reed, while allowing the outer longitudinal margins of a secured reed to vibrate freely.

In addition to using the rounded ribs for smooth gliding over the lower half of the reed, the screws 20 can be used to allow further adaptation by the ligature 10 to wide dimensions of single-reed mouthpieces (almost as if an O-ring).

The ligatures can be made of a wide variety of materials. Preferred embodiments of the subject ligature are made of a non-dampening material such as metal. The strength of the metal, combined with three adaptive metal fingers across the back, and rounded surface on the lower half of the reed can together establish a glide in the adjustment process and stoutness of posture in the tightening process. Although the preferred embodiments use metal, the present invention is applicable to any material capable of holding the reed in place in a manner creating a negative space allowing both the mouthpiece and reed to define and maintain their unique qualities and dimensions.

The rounded ribs and the adaptive fingers allow the subject ligature to be used with a variety of mouthpieces and reeds because of the subject ligature's ability to adapt to the myriad designs and shapes of a single-reed mouthpiece.

According to the invention, once the ligature is secured by the tightening screws, additional negative space in the final adjustment is provided by the concavity.

In particular, in a preferred embodiment, a mild, elliptical concavity having a semi-spherical cross-section (half-mooned) in the middle third of one rounded rib, and most of the volume of the concavity being in the middle third of the rib, allows for a triangular negative space to be created laterally on top of the reed, thereby affording it longitudinal pressure from top to bottom on the reed, and latitudinal pressure from side-to-side across the front of the reed. This duality provides a unique and improved performance compared to related art ligatures. According to implementations of the subject ligature, the pressure applied to the reed immediately above the rounded rib 12 on one side, and the pressure of the other rib 13 comprising the concavity results in a freedom of vibration and a positive positional conformation unachieved in other ligatures. The combination of strength, resiliency, and adaptive negative-space renders it at once strong, adaptive, and flexible.

According to certain embodiments, the concavity (preferably an elliptical, half-mooned concavity) can provide one or more of the following enhancements: increased luminosity of sound, increased technical flexibility, lessened proclivity towards cracked overtones, quickened response, greater volumes of sound, and improved adaptability of intonation. This can increase the value of the instrument to the woodwind family and to the ensemble as a whole.

It should be understood that the examples and embodiments described herein are for illustrative purposes only and that various modifications or changes in light thereof will be suggested to persons skilled in the art and are to be included within the spirit and purview of this application and the scope of the appended claims. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

What is claimed is:

1. A ligature for securing a reed to a mouthpiece of a singe reed woodwind instrument, the ligature comprising:

a main body capable of conforming around a mouthpiece and reed;

tightening screws for holding the main body together across a longitudinal split of the main body, the tightening screws being manually adjustable to tighten and loosen the ligature about the mouthpiece; and rounded ribs affixed to the interior of the main body, the rounded ribs arranged to enable contact with the reed, wherein one of the rounded ribs comprises a concavity disposed to create a negative space against the reed.

2. The ligature according to claim 1, wherein the concavity creates a triangular negative space against the reed.

3. The ligature according to claim 2, wherein most of the volume of the concavity is located in the middle third of the rib.

4. The ligature according to claim 1, wherein the concavity has a recessed, ellipsoidal shape when viewed from above.

5. The ligature according to claim 4, wherein most of the volume of the concavity is located in the middle third of the rib.

6. The ligature according to claim 1, wherein the concavity has a crescent, hollowed shape when longitudinally sectioned and viewed from the side.

7. The ligature according to claim 6, wherein most of the volume of the concavity is located in the middle third of the rib.

8. The ligature according to claim 1, wherein the concavity has a semi-spherical cross-sectional shape when laterally sectioned and viewed end-on.

9. The ligature according to claim 8, wherein most of the volume of the concavity is located in the middle third of the rib.

10. The ligature according to claim 1, wherein the concavity is located on the rounded rib directly above the heads of the tightening screws.

11. The ligature according to claim 10, wherein most of the volume of the concavity is located in the middle third of the rib.

12. The ligature according to claim 1, wherein the main body and the rounded ribs are formed of non-dampening material.

13. The ligature according to claim 12, wherein most of the volume of the concavity is located in the middle third of the rib.

14. The ligature according to claim 12, wherein the non-dampening material comprises metal.

15. The ligature according to claim 14, wherein most of the volume of the concavity is located in the middle third of the rib.

16. The ligature according to claim 1, wherein the main body comprises a three-fingered collar.

17. The ligature according to claim 16, wherein most of the volume of the concavity is located in the middle third of the rib.

18. The ligature according to claim 1, wherein a second of the rounded ribs is solid.

19. The ligature according to claim 1, wherein the concavity in its longitudinal dimension is from ⅓ to ⅔ the length of the rib.

20. The ligature according to claim 19, wherein the concavity at its greatest depth is from ¼ to ⅝ the diameter of the rib.

* * * * *